US012780381B2

(12) United States Patent
Gonzalez

(10) Patent No.: US 12,780,381 B2
(45) Date of Patent: Nov. 3, 2026

(54) AUXILIARY BOAT PROPELLER SYSTEM

(71) Applicant: John Gonzalez, Mesa, AZ (US)

(72) Inventor: John Gonzalez, Mesa, AZ (US)

( * ) Notice: Subject to any disclaimer, the term of this patent is extended or adjusted under 35 U.S.C. 154(b) by 250 days.

(21) Appl. No.: 18/672,562

(22) Filed: May 23, 2024

(65) Prior Publication Data

US 2025/0360998 A1 Nov. 27, 2025

(51) Int. Cl.

| | |
|---|---|
| ***B63H 20/00*** | (2006.01) |
| ***B63H 20/02*** | (2006.01) |
| ***B63H 20/20*** | (2006.01) |
| ***B63H 21/21*** | (2006.01) |

(52) U.S. Cl.

CPC ..... *B63H 20/007* (2013.01); *B63H 20/02* (2013.01); *B63H 20/20* (2013.01); *B63H 21/213* (2013.01); *B63H 2020/003* (2013.01)

(58) Field of Classification Search

CPC ..... B63H 20/20; B63H 20/007; B63H 20/02; B63H 2020/003; B63H 21/213

See application file for complete search history.

(56) References Cited

U.S. PATENT DOCUMENTS 3,119,365 A 1/1964 Evans
3,756,186 A * 9/1973 Nordling ..... B63H 5/18 440/63
3,881,443 A * 5/1975 Hamp ..... B63H 20/007 440/6
4,092,946 A 6/1978 Kappas
4,304,556 A * 12/1981 Wilson ..... B63H 20/06 440/63
4,995,839 A * 2/1991 Havins ..... B63H 20/007 114/274
5,277,630 A * 1/1994 Clark ..... B63H 20/007 248/642
6,863,581 B2 * 3/2005 Anderson ..... B63H 20/007 248/642
7,004,804 B2 2/2006 Bernloehr
7,381,108 B1 * 6/2008 Salmon ..... B63H 21/22 440/6
7,510,450 B1 * 3/2009 Dresher ..... B63H 5/125 440/63
7,828,614 B2 * 11/2010 Cribbs ..... B63H 20/06 440/63
9,352,818 B2 5/2016 Reese
(Continued)

FOREIGN PATENT DOCUMENTS

CA 2513848 1/2006

*Primary Examiner* — Daniel V Venne
*Assistant Examiner* — Jovon E Hayes

(57) ABSTRACT

An auxiliary boat propeller system includes a support assembly, a trolling motor, a control assembly, and a power unit. The support assembly is attachable to a motor housing of a power boat motor. The trolling motor is pivotably attached to the support assembly and selectively movable between an active position adjacent to and an inactive position away from a propeller of a power boat motor, wherein the trolling motor is designed to provide lower speed propulsion as an alternative to higher speed propulsion of a power boat motor when a power boat motor or boat propeller is damaged or disabled or when trolling speed is required. The control assembly is operatively connected to the trolling motor to permit control of the trolling motor. The power unit is operatively connected to the trolling motor.

9 Claims, 9 Drawing Sheets

(56) References Cited

U.S. PATENT DOCUMENTS

| | | | | |
|---|---|---|---|---|
| D940,202 | S | 1/2022 | Busse | |
| 11,584,495 | B2 * | 2/2023 | Hunziker, II | B63H 20/06 |
| 2006/0234566 | A1 * | 10/2006 | Ando | B63J 3/02 440/1 |
| 2009/0142974 | A1 * | 6/2009 | Strobel | B63H 20/02 440/63 |
| 2012/0247381 | A1 * | 10/2012 | Winiski | B63H 20/12 114/144 R |
| 2019/0137993 | A1 * | 5/2019 | Bertrand | B63H 25/02 |
| 2024/0132189 | A1 * | 4/2024 | Ikegaya | B63H 5/125 |

* cited by examiner

AUXILIARY BOAT PROPELLER SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to boat propulsion systems and more particularly pertains to a new auxiliary boat propeller system for use in emergencies, such as when the main power boat motor is damaged or disabled, or for use when low trolling speed is required or desired, such as during fishing or in wake-free areas or during docking of a boat.

(2) Description of Related Art Including Information Disclosed Under 37 CFR 1.97 and 1.98

The prior art relates to boat propulsion systems. The prior art, as best understood, does not disclose an auxiliary boat propeller system that has a trolling motor attachable to a motor housing of a power boat motor and selectively movable between an active position and an inactive position, wherein the trolling motor is designed to provide lower speed propulsion as an alternative to higher speed propulsion of a power boat motor when a power boat motor or boat propeller is damaged or disabled or when trolling speed is required.

BRIEF SUMMARY OF THE INVENTION

An embodiment of the disclosure meets the needs presented above in an auxiliary boat propeller system generally comprising a support assembly, a trolling motor, a control assembly, and a power unit. The support assembly is attachable to a motor housing of a power boat motor. The trolling motor is pivotably attached to the support assembly and selectively movable between an active position adjacent to and an inactive position away from a propeller of a power boat motor, wherein the trolling motor is designed to provide lower speed propulsion as an alternative to higher speed propulsion of a power boat motor when a power boat motor or boat propeller is damaged or disabled or when trolling speed is required. The control assembly is operatively connected to the trolling motor to permit control of the trolling motor. The power unit is operatively connected to the trolling motor.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
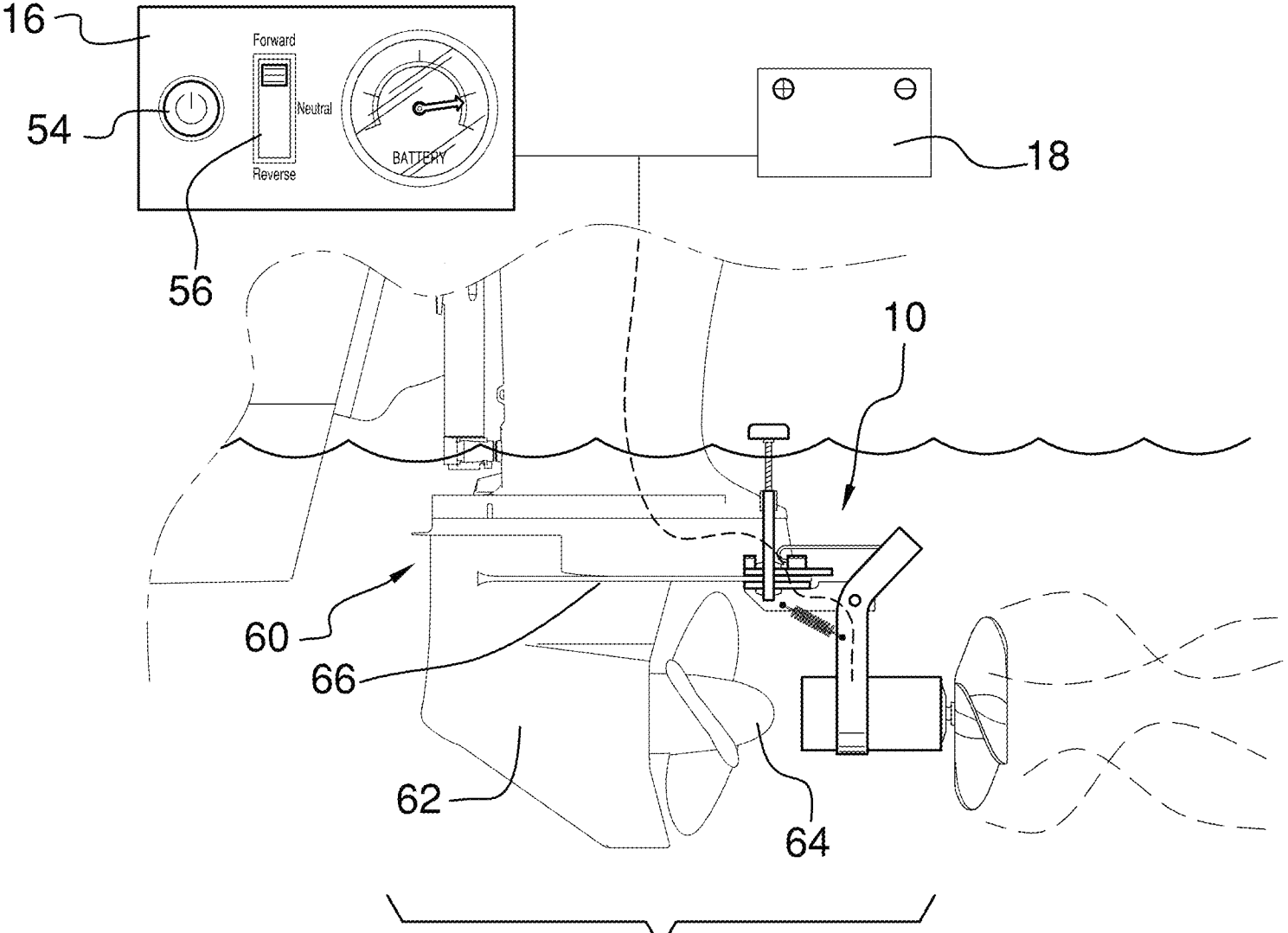
FIG. 1 is a side view of an auxiliary boat propeller system according to an embodiment of the disclosure in use.

With reference now to the drawings, and in particular to FIGS. 1 through 10 thereof, a new auxiliary boat propeller system embodying the principles and concepts of an embodiment of the disclosure and generally designated by the reference numeral 10 will be described.

As best illustrated in FIGS. 1 through 10, the auxiliary boat propeller system 10 generally comprises a support assembly 12, a trolling motor 14, a control assembly 16, and a power unit 18. The support assembly 12 is attachable to a motor housing 62 of a power boat motor 60. The trolling motor 14 is pivotably attached to the support assembly 12 and selectively movable between an active position (see FIGS. 1 and 2) adjacent to a power boat propeller 64 of a power boat motor 60 and an inactive position (see FIG. 3) away from a power boat propeller 64 of a power boat motor 60, wherein the trolling motor 14 is designed to provide lower speed propulsion as an alternative to higher speed propulsion of a power boat motor 60 when a power boat motor 60 or power boat propeller 64 is damaged or disabled or when trolling speed is required. The control assembly 16 is operatively connected to the trolling motor 14 to permit control of the trolling motor 14. The power unit 18 is operatively connected to the trolling motor 14.

Figure 2:
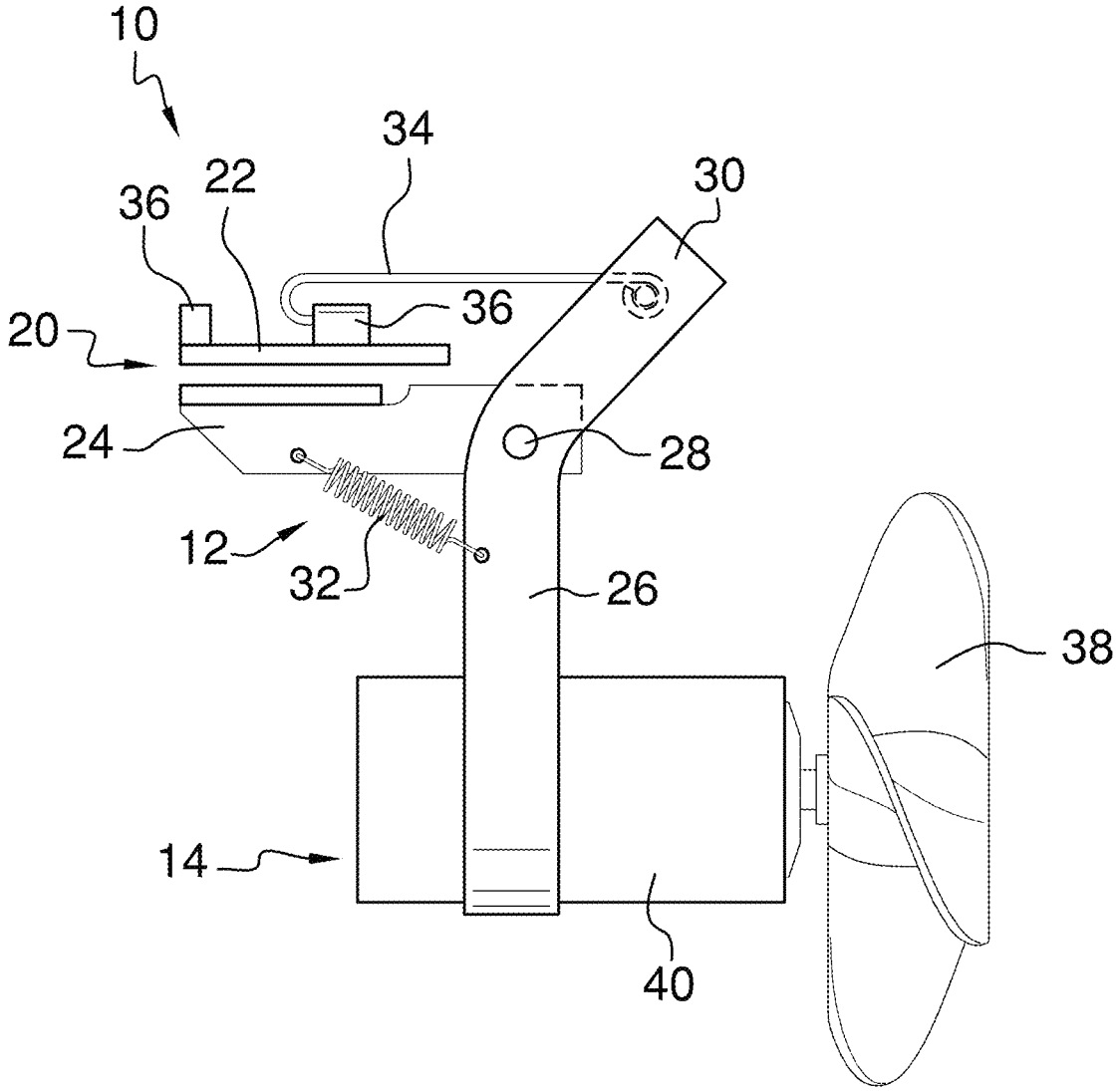
FIG. 2 is a side view of an embodiment of the disclosure.
Figure 3:
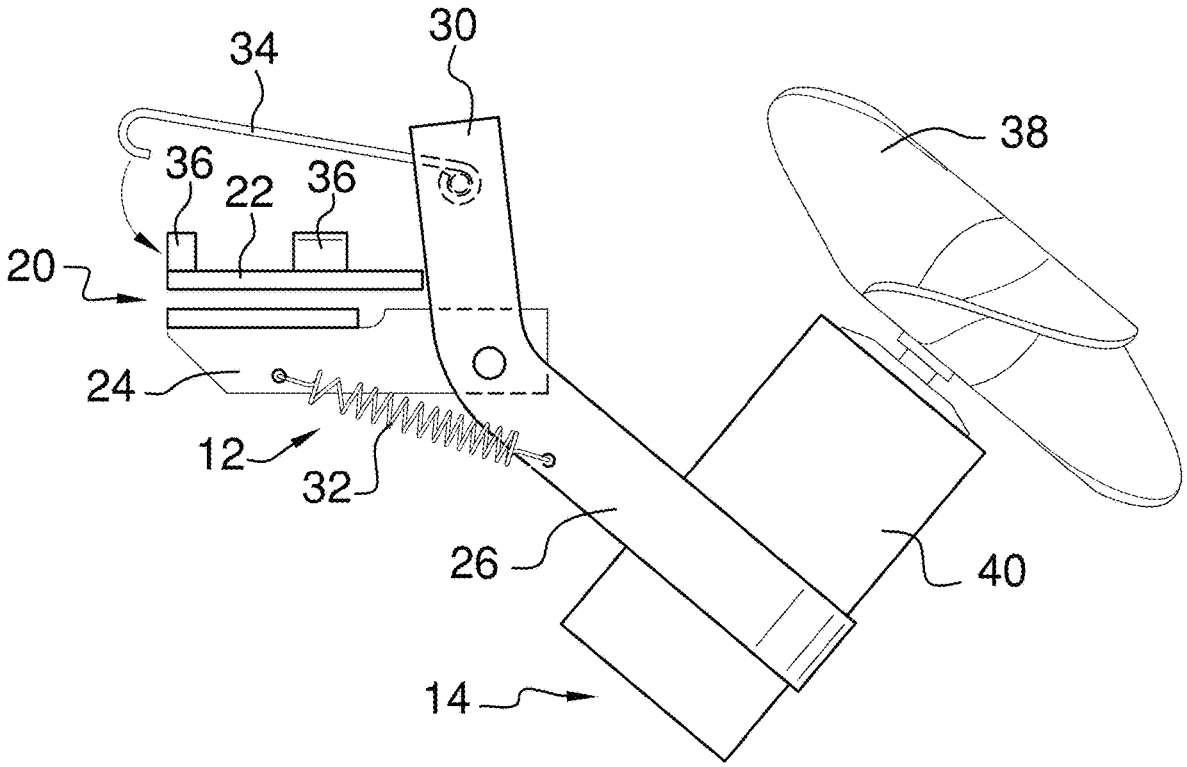
FIG. 3 is another side view of an embodiment of the disclosure.
Figure 4:
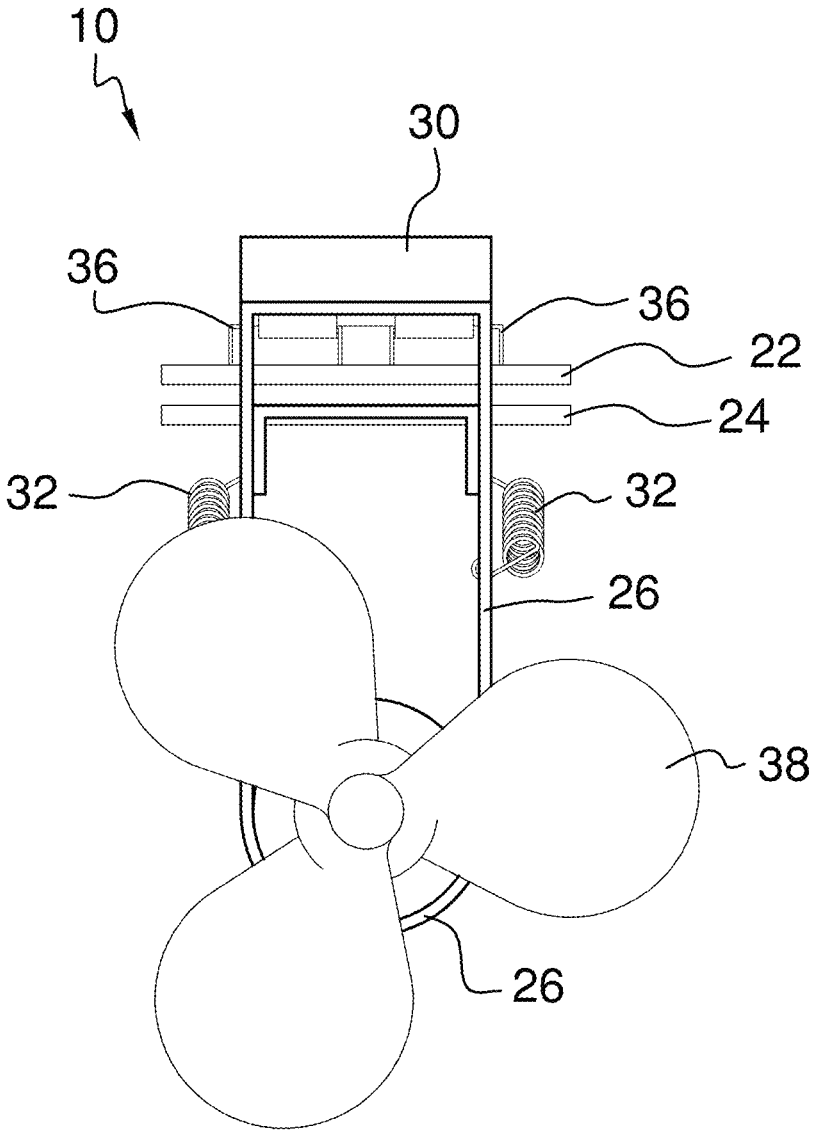
FIG. 4 is a front view of an embodiment of the disclosure.
Figure 5:
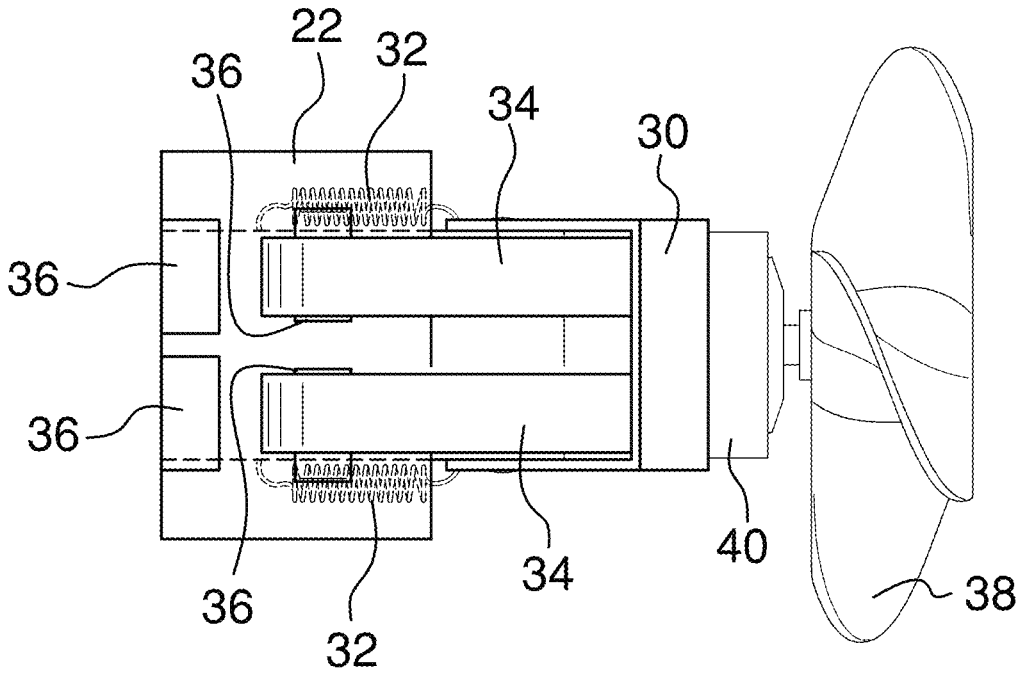
FIG. 5 is a top view of an embodiment of the disclosure.

As best shown in FIGS. 1 through 3, the support assembly 12 includes a bracket assembly 20 detachably connectable to an outdrive portion 66 of a motor housing 62 of a power boat motor 60. In the embodiment shown, the bracket assembly 20 includes a top portion 22 and a bottom portion 24 that can sandwich or releasably clamp a flat portion common to motor housings for power boat motors, though other locations and types of attachment are within the scope of the disclosure, such as plates permanently attached by screws or bolts, or an attachment assembly integrally formed as part of the motor housing 62. The support assembly 12 includes a support arm 26 pivotably mounted on the bracket assembly 20 by a pivot hinge 28, to which support arm 26 the trolling motor 14 is attached. In the embodiment shown, the support arm 26 includes a handle 30 designed to be grasped by a user to pivot the support arm 26 and selectively move the trolling motor 14 between the active position (see FIG. 2) and the inactive position (see FIG. 3). The handle 30 could be of any design, such as a horizontal handle, a knob, or a mechanical linkage. The support assembly 12 includes a spring 32 connected to the bracket assembly 20 and the support arm 26 to bias the support arm 26 toward the active position. The spring 32 helps keep the support arm 26 and thus the trolling motor 14 in the active position during operation. The support assembly 12 includes a locking arm 34 attached to the support arm 26 and designed to detachably connect to the bracket assembly 20 to lock the support arm 26 in the active position and the inactive position. In the embodiment shown, the locking arm 34 is the form of a latch that hooks into a latch receiver 36 for a secure connection.

The trolling motor 14 itself includes a propeller 38, an electric motor 40, and a drive gear assembly 42 operatively connecting the electric motor 40 to the propeller 38. The figures, such as FIGS. 1, 6, 7, and 10, show examples of gear assemblies and other motor components that are usable in at least one possible embodiment, though essentially any trolling motor 14 is within the scope of the disclosure.

Figure 6:
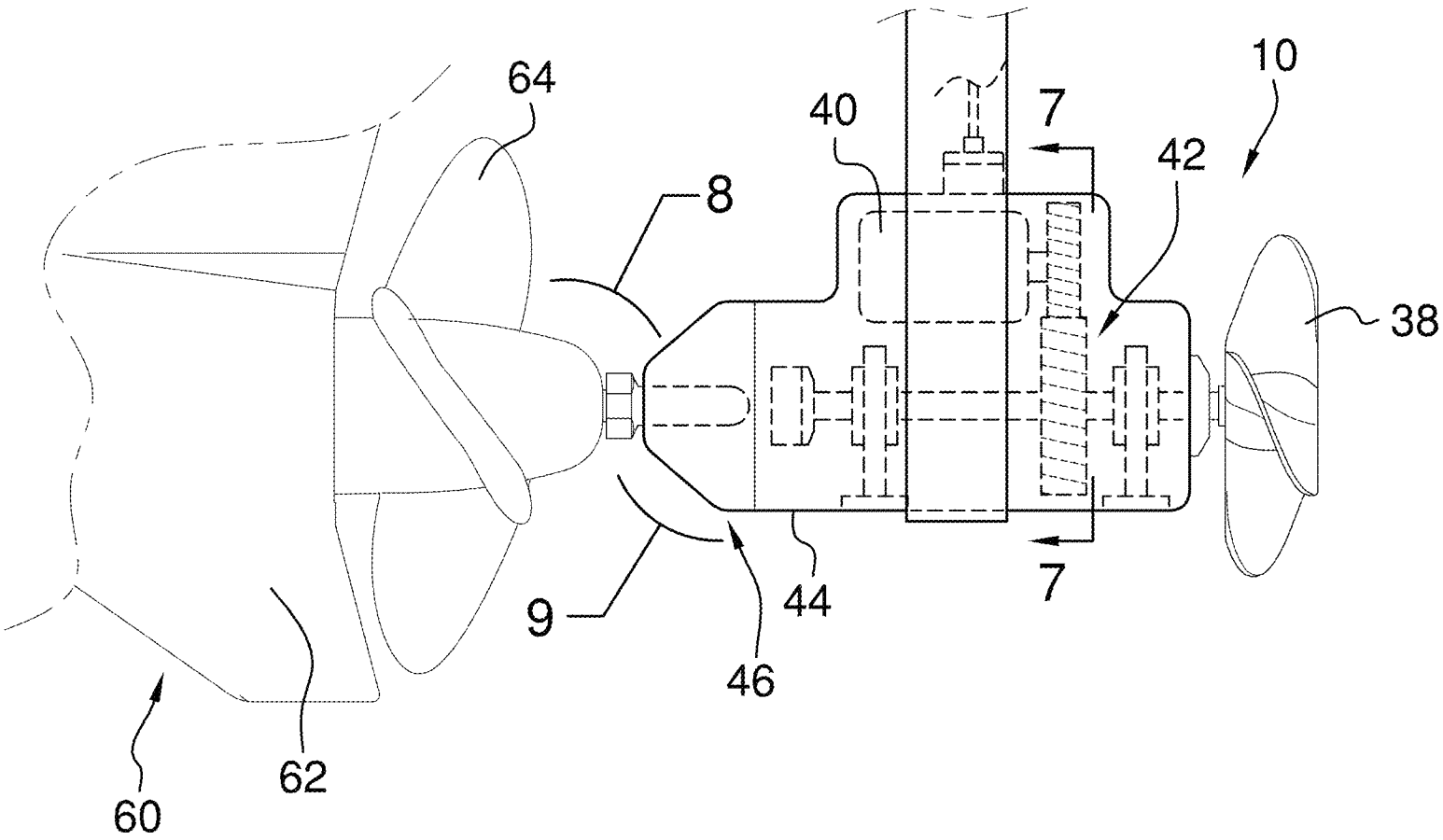
FIG. 6 is a side view of an alternative embodiment of the disclosure.
Figure 7:
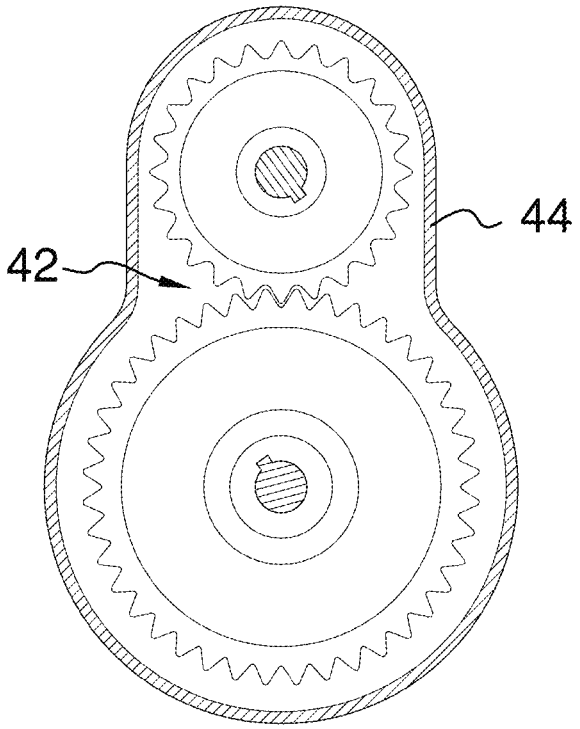
FIG. 7 is a cross-sectional view of the alternative embodiment of the disclosure.
Figure 8:
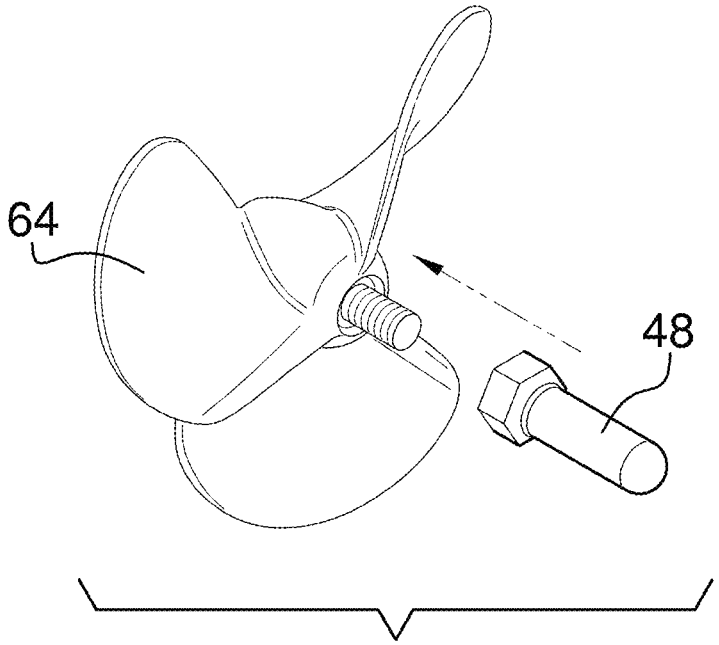
FIG. 8 is a perspective view of a portion of the alternative embodiment of the disclosure.
Figure 9:
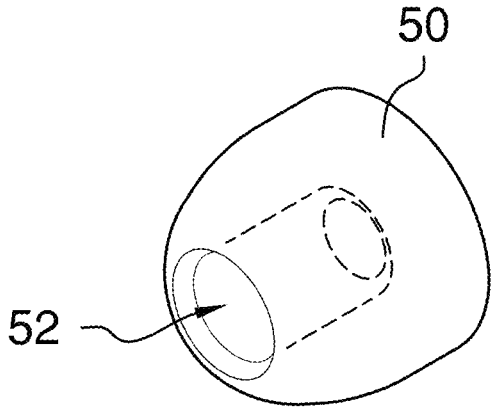
FIG. 9 is a perspective view of a portion of the alternative embodiment of the disclosure.
Figure 10:
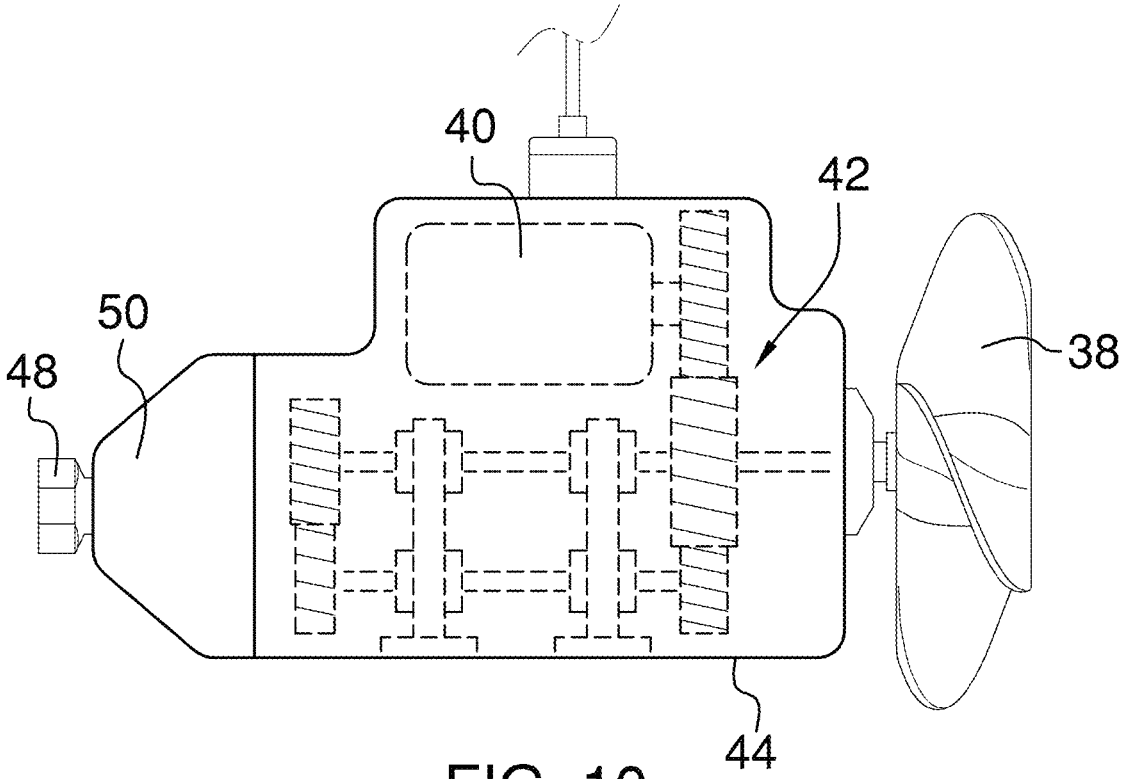
FIG. 10 is a cross-sectional view of an embodiment of the disclosure.

In an alternative embodiment shown in FIGS. 6 through 10, the trolling motor 14 includes a housing 44 and a stabilizing assembly 46 connected thereto. As shown in FIGS. 8 and 9, the stabilizing assembly 46 includes a shaft piece 48 connectable to a propeller shaft of a power boat motor 60 and a cap portion 50 that has a receptacle 52 designed to receive the shaft piece 48. In the embodiment shown in FIG. 8, the shaft piece 48 includes a nut that can be screwed onto a threaded portion of the power boat propeller 64. When the trolling motor 14 is in the active position, as shown in FIG. 6, the shaft piece 48 is inserted into the cap portion 50, and thus the stabilizing assembly 46 stabilizes the trolling motor 14 and compensates for vibrations during operation of the trolling motor 14.

As shown in FIG. 1, the control assembly 16 includes a power button 54 and a forward and reverse switch 56 to control the operation of the trolling motor 14. Other embodiments of the control assembly 16 designed to control specific trolling motors are within the scope of the disclosure. The power unit 18 includes a rechargeable or replaceable battery, such as any standard boat battery.

The auxiliary boat propeller system 10 is used primarily for emergency purposes, but also can be used any time trolling speed is required or desired. For example, if a user is operating a power boat having a power boat motor 60, and the power boat motor 60 or a component thereof, such as the power boat propeller 64, becomes damaged or disabled, the user can selectively move the trolling motor 14 from the inactive position away from the power boat propeller 64 to the active position adjacent to the power boat propeller 64. The user therefore will not have to be stranded waiting for assistance or repair, but instead can drive his boat to a safe location to wait for assistance or to a dock area. Since the auxiliary boat propeller system 10 is connected to the power boat motor 60 and functions in place of the power boat motor 60, the user can use the steering mechanism of the power boat. The user can also use the auxiliary boat propeller system 10 when trolling speed is required, such as during fishing or docking or in wake-free zones. In that situation, the user can switch off the higher speed power boat motor 60 and instead utilize the lower speed trolling motor 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An auxiliary boat propeller system comprising:

a support assembly attachable to a motor housing of a power boat motor;

a trolling motor pivotably attached to said support assembly and selectively movable between an active position adjacent to and an inactive position away from a propeller of a power boat motor, wherein said trolling motor is configured to provide lower speed propulsion as an alternative to higher speed propulsion of a power boat motor when a power boat motor or power boat propeller is damaged or disabled or when trolling speed is required;

a control assembly operatively connected to said trolling motor to permit control of said trolling motor; and a power unit operatively connected to said trolling motor;

wherein said support assembly comprises a bracket assembly detachably connectable to an outdrive portion of a motor housing of a power boat motor;

wherein said support assembly comprises a support arm pivotably mounted on said bracket assembly by a pivot hinge, to which said support arm said trolling motor are attached; and wherein said support assembly comprises a locking arm attached to said support arm, said locking arm including a hook selectively insertable into one of a pair of latch receivers on said bracket assembly such that said locking arm is configured to detachably connect to said bracket assembly to lock said support arm in said active position and said inactive position.

2. The auxiliary boat propeller system of claim 1, wherein said support arm comprises a handle configured to be grasped by a user to pivot said support arm and selectively move said trolling motor between said active position and said inactive position.

3. The auxiliary boat propeller system of claim 1, wherein said support assembly comprises a spring connected to said bracket assembly and said support arm to bias said support arm toward said active position.

4. The auxiliary boat propeller system of claim 1, wherein said trolling motor comprises a propeller, an electric motor, and a drive gear assembly operatively connecting said electric motor to said propeller.

5. The auxiliary boat propeller system of claim 1, wherein said trolling motor comprises a housing and a stabilizing assembly connected thereto, wherein said stabilizing assembly comprises a shaft piece connectable to a propeller shaft of a power boat motor and a cap portion comprising a receptacle configured to receive said shaft piece when said trolling motor is in said active position to stabilize said trolling motor and compensate for vibrations.

6. The auxiliary boat propeller system of claim 1, wherein said control assembly comprises a power button and a forward and reverse switch.

7. The auxiliary boat propeller system of claim 1, wherein said power unit comprises a rechargeable or replaceable battery.

8. An auxiliary boat propeller system comprising:

a support assembly attachable to a motor housing of a power boat motor, wherein:

said support assembly comprises a bracket assembly detachably connectable to an outdrive portion of a motor housing of a power boat motor, said support assembly comprises a support arm pivotably mounted on said bracket assembly by a pivot hinge, to which support arm said trolling motor is attached, said support arm comprises a handle configured to be grasped by a user to pivot said support arm and selectively move said trolling motor between said active position and said inactive position, said support assembly comprises a spring connected to said bracket assembly and said support arm to bias said support arm toward said active position, said support assembly comprises a locking arm attached to said support arm, said locking arm including a hook selectively insertable into one of a pair of latch receivers on said bracket assembly such that said locking arm is configured to detachably connect to said bracket assembly to lock said support arm in said active position and said inactive position;

a trolling motor pivotably attached to said support assembly and selectively movable between an active position adjacent to and an inactive position away from a propeller of a power boat motor, wherein said trolling motor is configured to provide lower speed propulsion as an alternative to higher speed propulsion of a power boat motor when a power boat motor or power boat propeller is damaged or disabled or when trolling speed is required, wherein:

said trolling motor comprises a propeller, an electric motor, and a drive gear assembly operatively connecting said electric motor to said propeller;

a control assembly operatively connected to said trolling motor to permit control of said trolling motor, wherein:

said control assembly comprises a power button and a forward and reverse switch; and a power unit operatively connected to said trolling motor, wherein:

said power unit comprises a rechargeable or replaceable battery.

9. The auxiliary boat propeller system of claim 8, wherein said trolling motor comprises a housing and a stabilizing assembly connected thereto, wherein said stabilizing assembly comprises a shaft piece connectable to a propeller shaft of a power boat motor and a cap portion comprising a receptacle configured to receive said shaft piece when said trolling motor is in said active position to stabilize said trolling motor and compensate for vibrations.

* * * * *